US005335924A

United States Patent [19]

Richards, Sr. et al.

[11] Patent Number: 5,335,924

[45] Date of Patent: Aug. 9, 1994

[54] RETRACTABLE BREAK PAD MECHANISM FOR IN-LINE SKATES

[76] Inventors: Kenneth E. Richards, Sr., Fairwind La., Cumberland, Me. 04096; Thomas H. Brown, R.R. #7 Box 595, Augusta, Me. 04330

[21] Appl. No.: 51,644

[22] Filed: Apr. 26, 1993

[51] Int. Cl.[5] ..... A63C 17/14

[52] U.S. Cl. ..... 280/11.2; 188/5

[58] Field of Search ..... 280/11.2, 11.22, 11.23, 280/11.27, 11.28, 11.19; 188/5, 6, 7

[56] References Cited

U.S. PATENT DOCUMENTS

| | | | |
|---|---|---|---|
| 337,151 | 3/1886 | Harris, Jr. | 280/11.2 |
| 4,054,296 | 10/1977 | Sullins | 280/11.2 |
| 4,076,266 | 2/1978 | Krausz | 280/11.2 |
| 4,088,334 | 5/1978 | Johnson | 280/11.2 |
| 4,167,225 | 9/1979 | Fragoso | 280/11.2 |
| 4,168,076 | 9/1979 | Johnson | 280/11.2 |
| 4,298,209 | 11/1981 | Peters | 280/11.2 |
| 4,817,974 | 4/1989 | Bergeron | 280/11.2 |
| 5,211,409 | 5/1993 | Mitchell et al. | 280/11.2 |

*Primary Examiner*—Richard M. Camby
*Attorney, Agent, or Firm*—Richard C. Litman

[57] ABSTRACT

A braking system for in-line skates allows a brake pad to have a retracted position for the brake pad during normal skating operations and an extended position for the brake pad during braking operations. The extended position is achieved by a spring actuated retainer screw attached to a pad retainer to drive the brake pad down to the pavement so as to contact the pavement without having to rock the braking foot back. Once the skater has come to a complete stop, the skater rocks the braking foot back at least a predetermined amount so as to push the retainer screw upwards a predetermined vertical distance so as to allow a retainer pin to engage the bottom portion of the head of the retainer screw, thereby maintain the spring in its compressed state and the brake pad in its retracted state.

6 Claims, 4 Drawing Sheets

RETRACTABLE BREAK PAD MECHANISM FOR IN-LINE SKATES

BACKGROUND OF THE INVENTION

1. Field of the Invention

The present invention relates to heel brake systems on roller skates. More particularly, the present invention relates to those heel brake systems for skates in which the distance the brake pad is located above the ground may be varied from an extended position to a retracted position, or vice versa, by the skater.

2. Description of the Prior Art

Heel brakes on roller skates are used for stopping when the skater extends the braking foot forward and rocks back the skate so that only the farthest back wheel of the skate and the brake pad of the heel brake behind that wheel are touching the ground. Toe brakes on roller skates are used for stopping when the skater places the braking foot rearward and rocks the skate forward so that only the front wheel of the skate and the brake pad on the toe brake in front of the front wheel are touching the ground. During normal skating, all wheels are touching the ground as the skate is kept parallel with the ground, but the brake pads of any toe or heel brakes is elevated at a predetermined distance above the ground.

The frictional force of a toe or heel brake is proportional to the downward force the skater is able to apply to the brake pad when touching the ground. For a heel brake, if the predetermined distance the brake pad is elevated above the ground is far, the skater has a harder time stopping since he or she must extend the braking foot further forward in order to rock the braking foot back enough for the brake pad to engage the ground. With the braking foot having to extend farther forward, less of the skater's weight is applied directly above the brake pad, thereby reducing the frictional force of the brake pad since a smaller downward force is applied between the brake pad and the ground. However, if the predetermined distance the brake pad of a heel brake is above the ground is small, the skater can go back on the braking foot only slightly before the brake is engaged. This is a disadvantage for in-line skates in which a skater may wish to rock back on the braking foot when doing certain maneuvers, such as hockey swoops.

U.S. Pat. No. 337,151 issued Mar. 2, 1886 to James B. Harris, Jr. discloses a roller skate have a heel brake located a predetermined distance above the surface of the ground.

U.S. Pat. No. 4,088,334 issued May 9, 1978 to Elmer E. Johnson discloses a braking system for a skateboard in which most of the weight of the rider is applied directly above the braking action.

U.S. Pat. No. 4,817,974 issued Apr. 4, 1989 to Robert L. Bergeron discloses a skate having a spring third wheel used during braking operations.

None of the above inventions and patents, taken either singly or in combination, is seen to describe the instant invention as claimed.

SUMMARY OF THE INVENTION

The present invention utilizes a heel brake system for skates, most advantageously used for in-line skates, having a retracted position for the brake pad during normal skating operations and an extended position for the brake pad during braking operations. In one embodiment of the present invention, the extended position is achieved by a compression spring actuated retainer screw attached to the pad retainer to drive the brake pad down to the pavement so as to contact the pavement without having to rock the braking foot back. However, since the retainer screw is spring actuated, greater braking power is achieved by rocking the braking foot backwards a small amount, thereby compressing the spring and increasing the downward force exerted on the brake pad in contact with the ground. Once the skater has come to a complete stop, the skater rocks the braking foot back at least a predetermined amount so as to push the retainer screw upwards a predetermined vertical distance so as to allow a retainer pin to engage the bottom portion of the head of the retainer screw, thereby maintain the compression spring in its compressed state and the brake pad in its retracted skate.

A knob is provided on one end of the retainer pin to allow the skater to push the pin the required predetermined vertical distance. The retainer pin is spring biased so as to maintain the retainer pin away from the screw. As the knob is pushed forward, the spring is compressed. The retainer pin engages the bottom portion of the head when the skater pushes the retainer pin a predetermined vertical distance towards the retainer screw as the braking foot is rocked back to at least the predetermined amount and is then allowed to rock forward so that all the wheels on the skate contact the ground. The frictional force between the bottom portion of the screw and the retainer pin is greater than the force exerted by the spring of the retainer pin. In this manner, the braking pad remains in its retracted position until the skater rocks back the braking foot at least the required predetermined amount to allow the brake pad to contact the ground. This jars the retainer screw, forcing the screw head upwards away from the retainer pin, thereby allowing the retainer pin to move away from the screw due to the biasing of the spring of the retainer pin. This in turn allows the spring of the retainer screw to push the retainer screw down, thereby placing the brake pad in its extended position as discussed above.

In a second embodiment of the present invention, the brake pad retainer is maintained in its retracted position by a tension spring. The brake pad retainer pivots about a center portion of the retainer with the brake pad located at a first end of the retainer. The tension spring is also attached at the first end of the brake pad retainer so as to apply an upward force on the first end of the brake pad retainer, thereby maintaining the brake pad in its retracted state.

One end of a cable is attached at a second end of the brake pad retainer opposite the first end so as to pull up one the second end, thereby causing the brake pad retainer to pivot about its center pushing the brake pad down to the ground in opposition to the tension force applied at the first end. The end of the cable opposite the one end thereof is attached to a handle. The handle is located in so as to provide the skater easy access thereof. When the skater wishes to stop, the skater pull on the handle to place the brake pad in its retracted state. Upon releasing the handle, the tension spring places the brake pad in its retracted state since the cable is no longer applying a counter rotational force about the center pivot location of the brake pad retainer.

Accordingly, it is a principal object of the invention to provide a braking system for an in-line skate allowing a brake pad to be alternately placed in an extended position and a retracted position.

It is another object of the invention to provide a braking system for an in-line skate having a brake pad easily placed in the extended position by rocking back on the braking foot at least a predetermined amount.

It is a further object of the invention to provide a braking system for an in-line skate having a brake pad easily placed in the retracted position by rocking back on the braking foot at least a predetermined amount and then pushing on a retainer pin before rocking the braking foot forward again.

Still another object of the invention is to provide a braking system which may be attacked to conventional in-line skates sold on the market at the present time.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
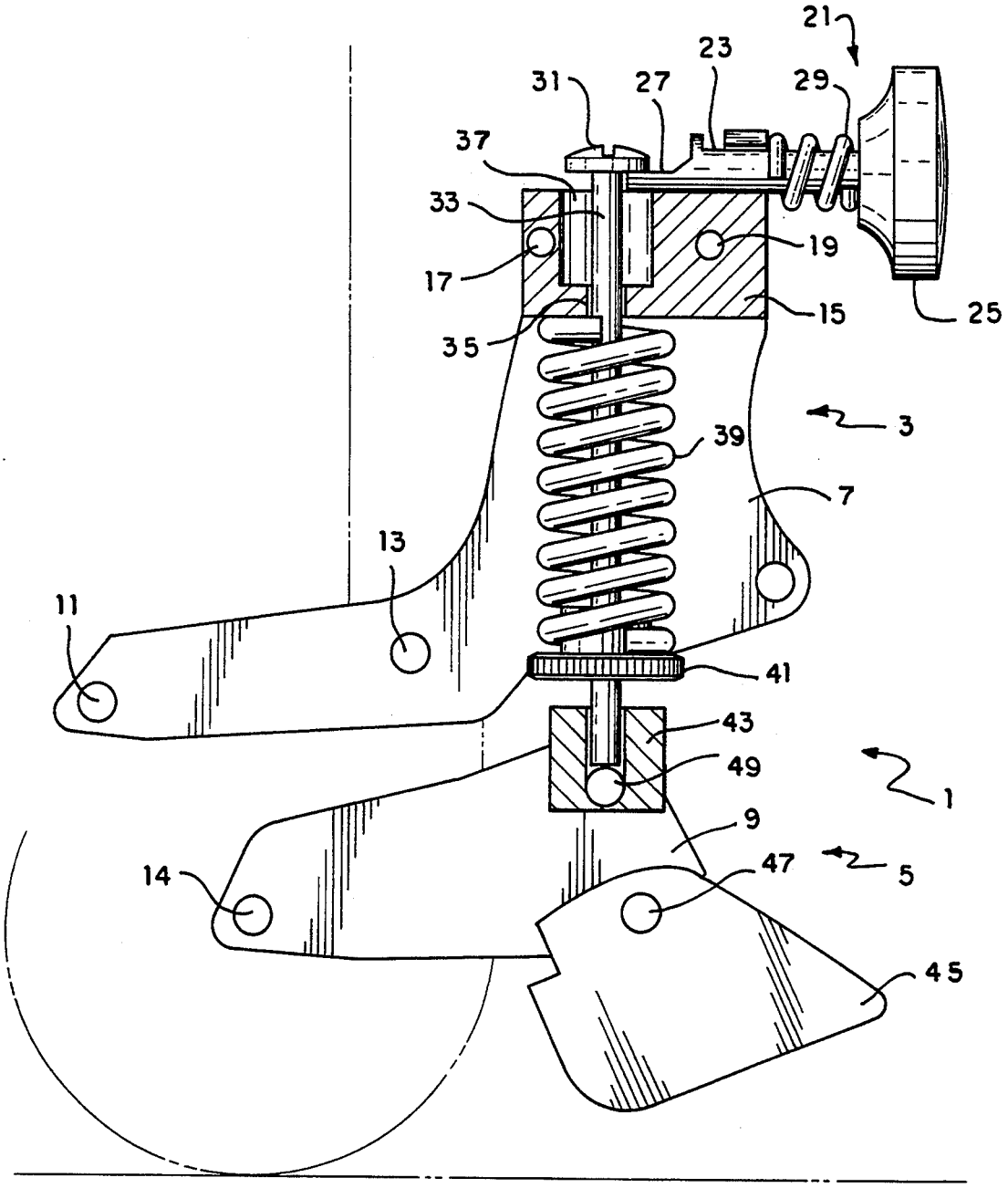
FIG. 1 is a partial cross-sectional side view of the first embodiment of the present invention with the brake pad in the retracted position.
Figure 2:
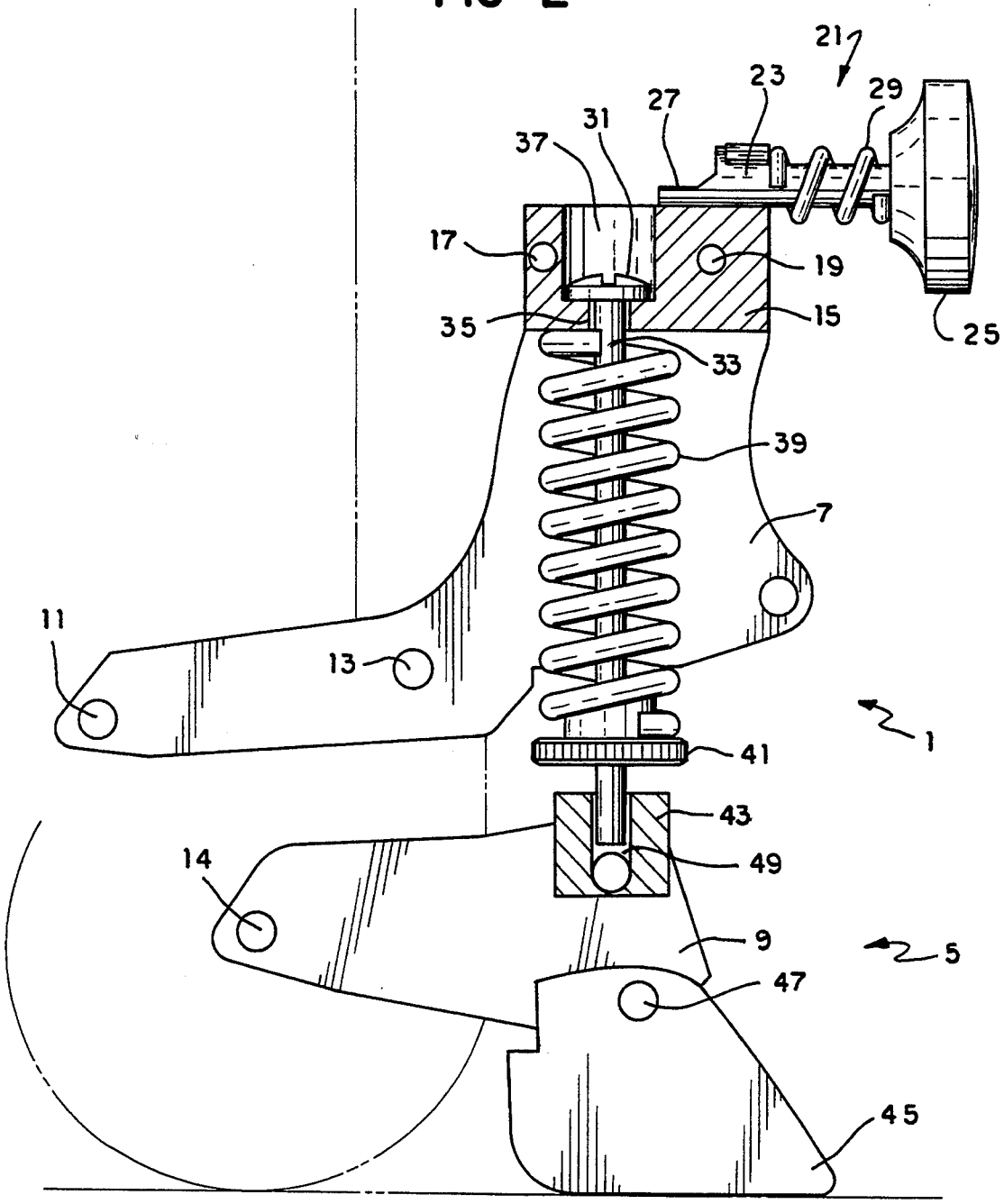
FIG. 2 is a partial cross-sectional side view of the first embodiment of the present invention with the brake pad in the extended position.

The braking system 1 of the first embodiment of the present invention has an upper frame piece 3 and a lower frame piece 5. As illustrated in FIGS. 1 and 2, the upper frame piece 3 includes a right side metal plate 7 and a left side metal plate identical thereto (not illustrated). The lower frame piece 5 includes a right side metal plate 9 and a left side metal plate identical thereto (not illustrated). The right side metal plate 7 is attached to the frame of a conventional pair of in-line skates through the use of screw holes 11 and 13 through which screws are placed in the conventional manner. The left side metal plate of the upper frame piece 3 is attached to the left side of the frame of the conventional pair of in-line skates in the same manner as the right side metal plate 7 is attached to the right side of the frame. The right side metal plate 9 is pivotally attached to the frame of the conventional pair of in-line skates through the use of hole 14 into which the screw attaching the back wheel of the skate is inserted. The left metal plate of the lower frame piece 5 is attached to the frame in the same manner. The lower frame piece 5 is therefore allowed to pivot along the center axis of the back wheel of the skate.

A spring block 15 is attached between the left and right side metal plates of the upper frame piece 3 through the use of screw holes 17 and 19. A retainer pin assembly 21 is located at the top of spring block 15 and includes a retainer pin 23 having a knob 25 located at one end thereof and a flat portion 27 located at the other end thereof. A retainer pin spring 29 is located between the knob 25 and the spring block 15. As shown in FIG. 1, the retainer pin spring 29 is compressed. The retainer pin assembly 21 remains in its closed position in opposition to the compressed retainer pin spring 29 due to the frictional force exerted on the flat portion 27 by the bottom of the head 31 of the retainer screw 33.

As illustrated in FIGS. 1, the retainer screw 33 passes through the spring block 15 through a hole 35. A retainer screw spring 39 surrounds the retainer screw 33 which is within the upper frame piece 3. The retainer screw spring 39 pushes up on the bottom portion of the spring block 15 and down on an adjustable nut 41, thereby providing a downward force on the screw holding the retainer pin assembly in its closed position. The bottom end of the retainer screw 33 is threadably attached to a swivel block 43 connected to the lower frame piece 5. The lower frame piece 5 serves as a brake pad retainer for the brake pad 45 attached to the lower frame piece 5 through the use of screw hole 47 located on the right side metal plate 9 and a like screw hole located on the left side metal plate of the frame piece 5 through which a conventional screw in placed.

During normal skating operations the brake pad 45 is maintained in its retracted state as illustrated in FIG. 1. If the skater were to rock back on the braking foot a predetermined amount so as to bump the brake pad, the retainer screw 33 would be jarred upwards. As the retainer screw 33 is jarred upwards, the bottom portion of the head 31 is lifted allowing the retainer pin 23 to retract backwards to its open position. In this manner the flat portion 27 of the retainer pin 23 is no longer located over a countersunk hole 37.

As shown in FIG. 2, the counter sunk hole 37 is large enough to allow the head 31 of the screw 33 to pass therethrough. The brake pad 45 is now extended so as to contact the ground. As the skater rocks back on the braking foot so as to push up on the brake pad 45 the brake pad 45 has a greater downward force exerted between it and the ground as the retainer spring is further compressed. Since the skater has to rock his or her braking foot only slightly backwards to achieve this effect, most of the weight of the skater can be located directly above the braking action.

As shown in FIG. 2, the adjusting nut 41 can be adjusted by hand to increase or decrease the amount the spring is compressed between the spring block 15 and the adjusting nut 41. The adjusting nut should not be adjusted so far upwards that the head 31 of the retainer screw 33 can not extend far enough above the spring block 15 before the adjusting nut contacts the bottom portion of the upper frame piece 3 so as to prevent the flat portion 27 of the retainer pin 23 from being insertable beneath the bottom portion of the head 31 when the skater rocks the braking foot back the predetermined amount. Further, the retainer screw 33 can be adjusted to various depths within the screw hole 49 of the swivel block 43, thereby varying the distance the brake pad 45 is located above the ground when in the retracted state. Also, as the brake pad wears, the retainer 33 should be loosened a predetermined amount from the swivel block 43 so as to allow the brake pad 45 to contact the ground when in the extended state with all wheels of the skate touching the ground.

Figure 3:
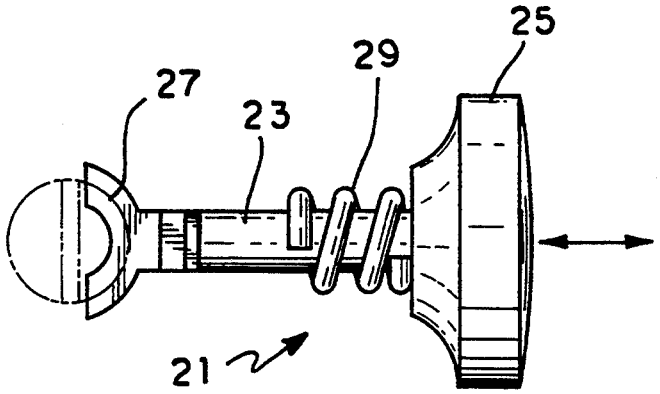
FIG. 3 is top view of the retainer pin of the first embodiment of the present invention.

In the first embodiment, the flat portion 27 would preferably have a semicircular configuration as shown in FIG. 3 with a semicircular cutout in the middle so as to fit partially around the retainer screw 33, thereby providing a greater surface area of the flat portion 27 which is in contact with the bottom portion of the head 31 when the brake pad is in its retracted state.

Figure 4:
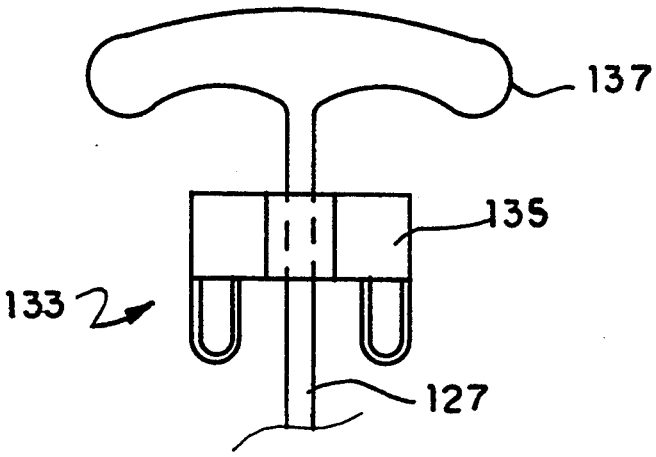
FIG. 4 is a side view of the cable handle arrangement for the second embodiment of the present invention.
Figure 5:
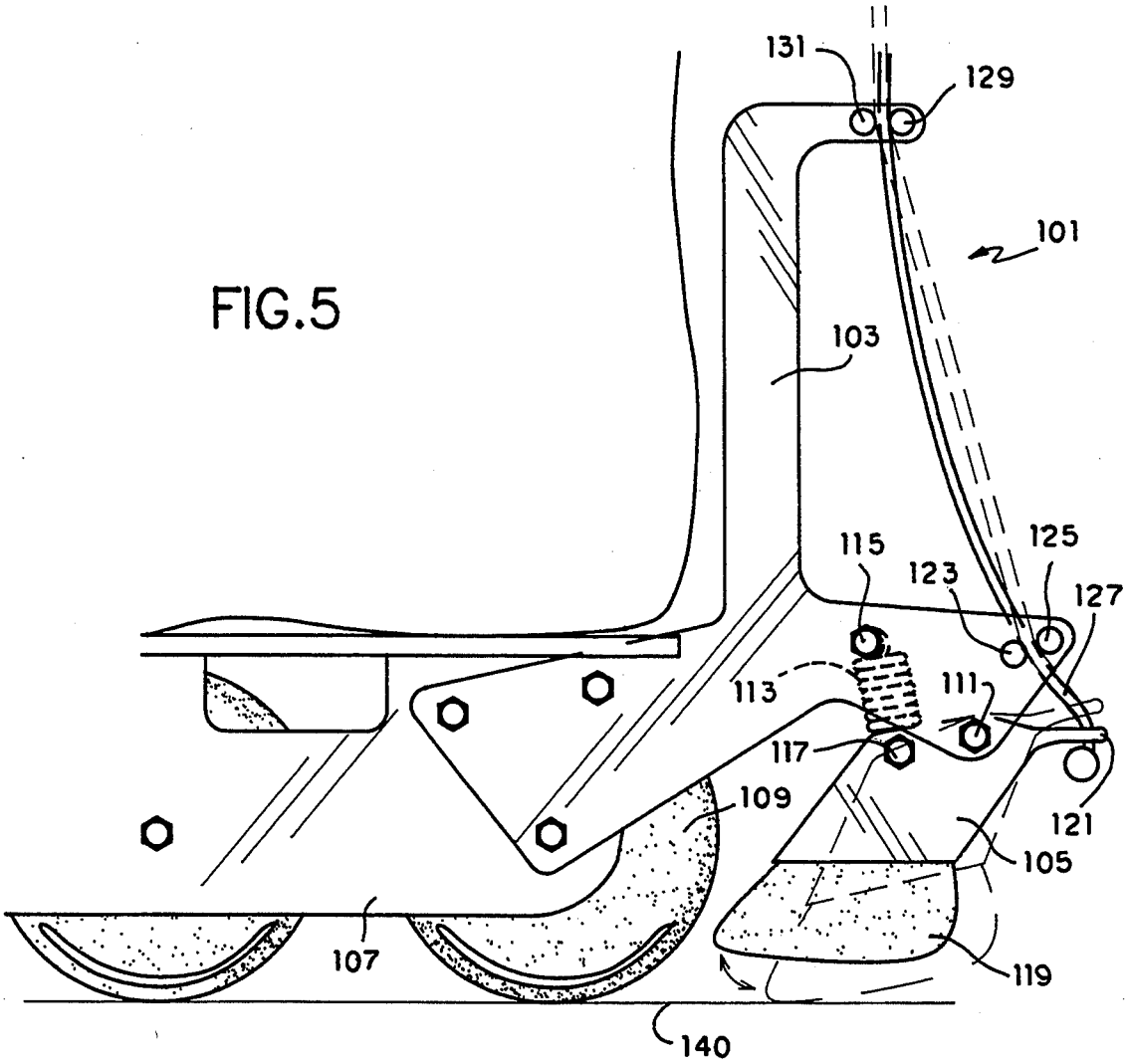
FIG. 5 is a side view of the second embodiment of the present invention.

In the second embodiment of the present invention, a handle arrangement 133 as illustrated in FIG. 4 is used to allow a user to activate the braking system 101 as illustrated in FIG. 5. As shown in FIG. 5, the braking system 101 has an upper frame piece 103 and a lower frame piece 105. The upper frame piece 103 is attached to the back of the wheel frame 107 of a conventional in-line skate. The upper frame piece 103, like the upper frame piece 3 of the first embodiment, is constructed of two metal plates attached to the wheel frame 107 in the same manner as the two metal plates of the frame piece 103 are attached to the wheel frame of a conventional in-line skate.

The lower frame piece 105 serves as the pad retainer for a brake pad 119. The lower frame piece 105, like the first embodiment frame piece 5, is constructed of two metal plates with the brake pad 119 located therebetween. The lower frame piece 105 has a first end thereof attached to a tension spring 113 by any conventional fastener 117. The other end of the tension spring 113 is attached to the upper frame piece 105 through the use of a conventional fastener 115. The other end of the brake pad 119 is attached to a cable 127. A center portion of the brake pad retainer 105 is pivotally connected to the frame 103 through the use of a conventional fastener 111. The conventional fasteners 111, 115, and 117 are preferably nut and screw arrangements.

As shown in FIG. 4, the handle arrangement 133 includes a handle retainer 135 attachable to some garment of the user. As the user pulls on the handle 137, tension is placed on the cable 127 applying a counter rotational force about the fastener 111 in opposition to the rotational force applied by the tension spring 113 once the break pad is moved from it retracted position. If enough tension is placed on the cable 127, the break pad retainer is rotated sufficiently to cause the break pad 119 to engage the ground surface 140. Once the user releases the handle 137, tension on the cable is released and the rotational force applied by the tension spring 113 forces the break pad retainer 105 to rotate so as to place the break pad in its retracted position.

It is to be understood that the present invention is not limited to the sole embodiments described above, but encompasses any and all embodiments within the scope of the following claims. For example, there exists retractable mechanism which would not require the manual operation of a retainer pin in order to alternate between a retracted and an extended state, such as those used in retractable pins. Such a substitution of a retractable mechanism which toggles between a retracted state and an extended state would be an obvious substitution for the disclosed retractable mechanisms.

We claim:

1. A braking system for a skate having wheels for skating on a ground surface, said braking system comprising:

a brake pad retainer;

a brake pad attached to said brake pad retainer, said brake pad having a retracted state when located a first predetermined distance above the ground surface with all wheels of the skate in contact with the ground surface and an extended state when located a second predetermined distance above the ground surface with all wheels of the skate in contact with the ground surface, said second predetermined distance being less than said first predetermined distance;

means for retracting said brake pad from said extended state to said retracted state, wherein said means for retracting includes a locking mechanism for maintaining said brake pad in said retracted position when said brake pad is pushed upwards at least said first predetermined distance so as to enable the engagement of said locking mechanism with said brake pad retainer; and means for extending said brake pad from said retracted state to said extended state, wherein said means for extending includes a compression spring for driving said brake pad from said retracted position to said extended position.

2. A braking system as claimed in claim 1, further comprising a frame portion attachable to said skate for housing said means for retracting and means for extending, said break pad retainer having a pivotal attachment to said frame portion.

3. A braking system as claimed in claim 1, including means for adjusting said first and second predetermined distances.

4. A braking system as claimed in claim 1, wherein said compression spring resists an upwards push of said brake pad in said extended state with a predetermined amount of force, said braking system further including means for adjusting said predetermined amount of force.

5. A braking system as claimed in claim 2, wherein said means for retracting includes a tension spring for placing said brake pad into said retracted position and for maintaining said break pad in said retracted position once said tension spring has placed said break pad into said retracted position by placing a rotational force about said pivotal attachment.

6. A braking system as claimed in claim 5, wherein said means for extending includes a cable for applying a counter rotational force about said pivotal attachment in opposition to said rotational force applied by said tension spring.

* * * * *